US007293695B2

(12) United States Patent
Stier

(10) Patent No.: US 7,293,695 B2
(45) Date of Patent: Nov. 13, 2007

(54) INTERACTIVE COMPARTMENTED FOOD PACKAGE

(75) Inventor: David E. Stier, Loveland, OH (US)

(73) Assignee: KFC Corporation, Louisville, KY (US)

( * ) Notice: Subject to any disclaimer, the term of this patent is extended or adjusted under 35 U.S.C. 154(b) by 713 days.

(21) Appl. No.: 10/474,618

(22) PCT Filed: Mar. 7, 2003

(86) PCT No.: PCT/US03/07363

§ 371 (c)(1),
(2), (4) Date: May 6, 2004

(87) PCT Pub. No.: WO03/076280

PCT Pub. Date: Sep. 18, 2003

(65) Prior Publication Data

US 2004/0178253 A1 Sep. 16, 2004

Related U.S. Application Data

(60) Provisional application No. 60/362,077, filed on Mar. 7, 2002.

(51) Int. Cl.
*B65D 25/04* (2006.01)

(52) U.S. Cl. ..... 229/120.14; 206/564; 229/159; 229/160; 229/904

(58) Field of Classification Search ..... 229/120.14, 229/904, 120.13, 902, 906, 159, 160, 122, 229/155; 206/561, 562, 563, 564, 565
See application file for complete search history.

(56) References Cited

U.S. PATENT DOCUMENTS 2,137,420 A * 11/1938 Soybel ..... 299/169
2,297,571 A * 9/1942 Lowey ..... 229/155
2,419,646 A 4/1947 Inman
2,472,516 A 6/1949 Buttery
2,646,916 A 7/1953 Meller
2,970,738 A * 2/1961 Strange ..... 229/120.14
3,401,865 A * 9/1968 Holstrom ..... 229/159
3,684,084 A * 8/1972 Kanzelberger ..... 229/159
3,884,350 A * 5/1975 Johansson ..... 229/122
4,053,099 A 10/1977 Lock
4,341,339 A * 7/1982 Zore ..... 229/148
4,489,879 A * 12/1984 Mode ..... 206/563
5,222,657 A 6/1993 Holland, Jr.
5,246,161 A 9/1993 Kapp

FOREIGN PATENT DOCUMENTS

EP 385908 9/1990

(Continued)

*Primary Examiner*—Gary E Elkins
(74) *Attorney, Agent, or Firm*—Stites & Harbison, PLLC; David W. Nagle, Jr.

(57) ABSTRACT

An interactive food serving package (10) formed from a blank (B) of paperboard has a tray (11) with openings (19) for receiving items, and a combined lid and game piece (12) detachably connected to the tray. The tray has front and back walls (13, 14), opposite end walls (16, 17), a bottom wall (15) and a top wall (18). The front and back walls are pivotally connected to the top and bottom walls, and the end walls comprise releasably interlocking end closure flaps (24, 25 and 46, 47), whereby the tray may be moved between a flattened condition with the top and bottom walls lying flat against one another, and an open expanded condition with the top and bottom walls in spaced parallel relationship. Cuts made in the top wall define a plurality of partition panels (29, 30 and 36, 37) extending perpendicularly between the top and bottom walls in the expanded condition, and including at least one transverse partition panel (36, 37) holding the tray in the expanded position.

12 Claims, 5 Drawing Sheets

FOREIGN PATENT DOCUMENTS

| | | | | | |
|---|---|---|---|---|---|
| FR | 1259433 | 4/1961 | GB | 2240323 A | * 7/1991 |

* cited by examiner

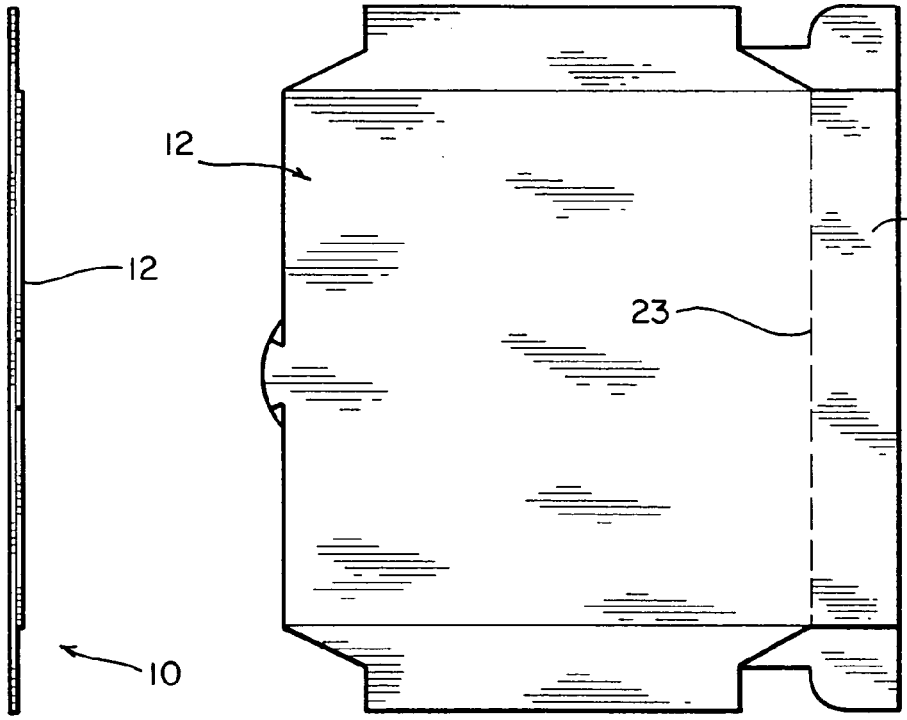
FIG. 7
FIG. 6
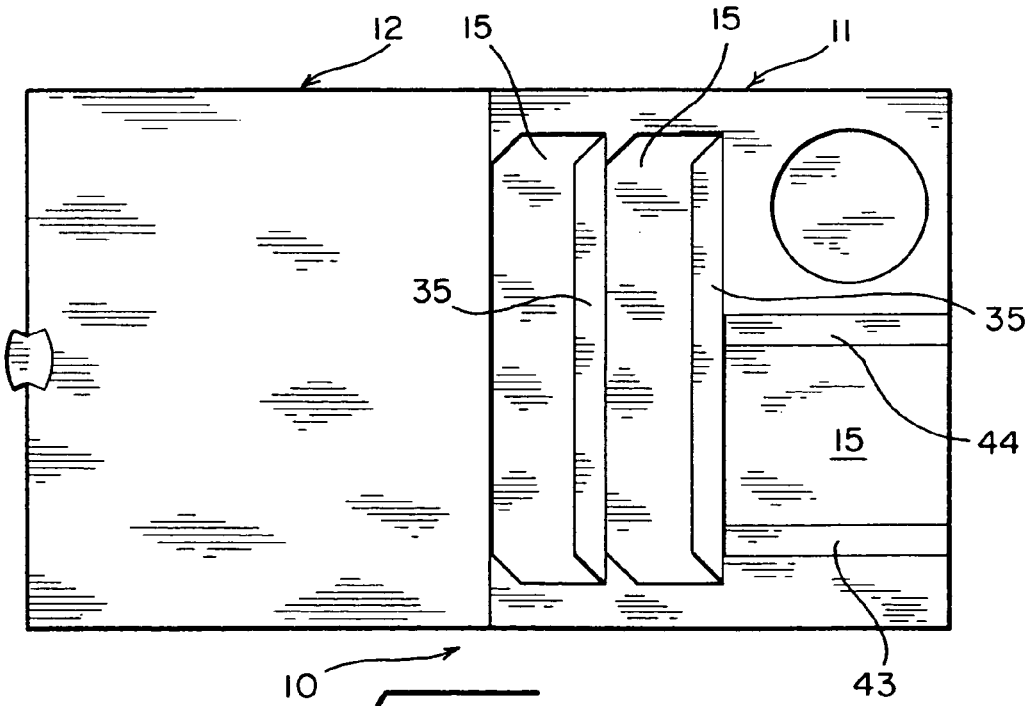
FIG. 10

INTERACTIVE COMPARTMENTED FOOD PACKAGE

This application claims the benefit of U.S. Provisional Patent Application Ser. No. 60/362,077, filed Mar. 7, 2002.

TECHNICAL FIELD

This application relates to compartmented food packages. More particularly, the invention relates to an inexpensive compartmented food package, wherein the package is easy to set up, remains securely in an expanded and operative condition, and has features making it interactive and interesting for children.

BACKGROUND ART

Multi-compartmented food packages, including serving trays and cartons, are known in the art. These trays and cartons are used to receive and carry food in fast food restaurants, at sporting events, merchandising shows, and the like. The trays and cartons may be designed to hold the food while it is being consumed, and typically have a series of openings or compartments for holding different food items and/or beverages. Some prior art trays and cartons are constructed so that they can be shipped and stored in a flattened condition, and then opened into an expanded and operative condition by store personnel for receiving the food items. These cartons or trays also may be provided with a lid.

Many conventional serving trays and cartons are constructed of paperboard that is folded and glued to form the tray or carton. Some of these are cut from a single blank of paperboard material that is scored, folded and glued to form the tray or carton, and others comprise multiple parts that are assembled together.

Prior art serving trays and food cartons either are relatively complicated and expensive to make, or are difficult to open into an expanded and operative condition, or do not reliably remain in the expanded and operative condition.

Moreover, conventional serving trays or food cartons serve the single function of holding food and beverage. They are devoid of graphics or interactive components that can attract and hold a child's interest, although some do have material printed on them to identify the store in which the tray or carton is used, or other indicia primarily serving an advertising function.

Conventional serving trays or food cartons that are shipped and stored flat and then opened into an expanded and operative condition by store personnel should be inexpensive to make and easy to manipulate. Further, they should be durable and reliable in use, that is, they should remain in the expanded and operative condition after they have been set up by store personnel. Moreover, it would be desirable to have a food package that embodies elements which serve a function other than to hold or contain food, i.e., an interactive component which can entertain and hold a child's interest.

DISCLOSURE OF THE INVENTION

An exemplary food package made in accordance with the invention is made from a single blank of paperboard material. It is shipped and stored flat and then opened into an expanded and operative condition by store personnel. It is inexpensive to make, easy to manipulate, and durable and reliable in use, that is, it remains in the expanded and operative condition after it has been set up by store personnel. Moreover, it embodies elements which serve a function other than to hold or contain food, i.e., it includes an interactive component which can entertain and hold a child's interest.

More specifically, the food package of the invention is a "kids meal" package with means allowing pre-staging of some meal items and final assembly at the time of sale. The package comprises a base or tray portion and a detachable lid, includes a means for making it interactive and interesting for children, and can be used for carry out or in-store dining. The package has some pre-glued panels and arrives at the store as a flattened tubular structure, with the lid overlying the flattened tray portion. Store personnel can open and erect the package by first expanding the tubular structure and then folding in pre-cut partition panels to hold the package in an expanded and operative condition, after which end closure flaps are folded inwardly and interlocked with one another to lock the package in its expanded and operative condition. Multiple compartments are formed in the tray portion for holding meal items, condiments, and game or toy items. The detachable lid is integrally formed with the tray portion and can be folded over the compartments to protect the items held in the compartments. The lid can be provided with graphics or other material and separated from the package along a perforated line to serve as a separate collectible item or game piece or the like.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein:

FIG. 6 is a top plan view of the exemplary package of the invention in its folded and flattened condition.

FIG. 7 is an end view in elevation of the exemplary package of FIG. 6.

FIG. 10 is a top plan view of the exemplary package in the fully expanded and operative condition, with the lid in open position.

BEST MODE FOR CARRYING OUT THE INVENTION

Figure 1:
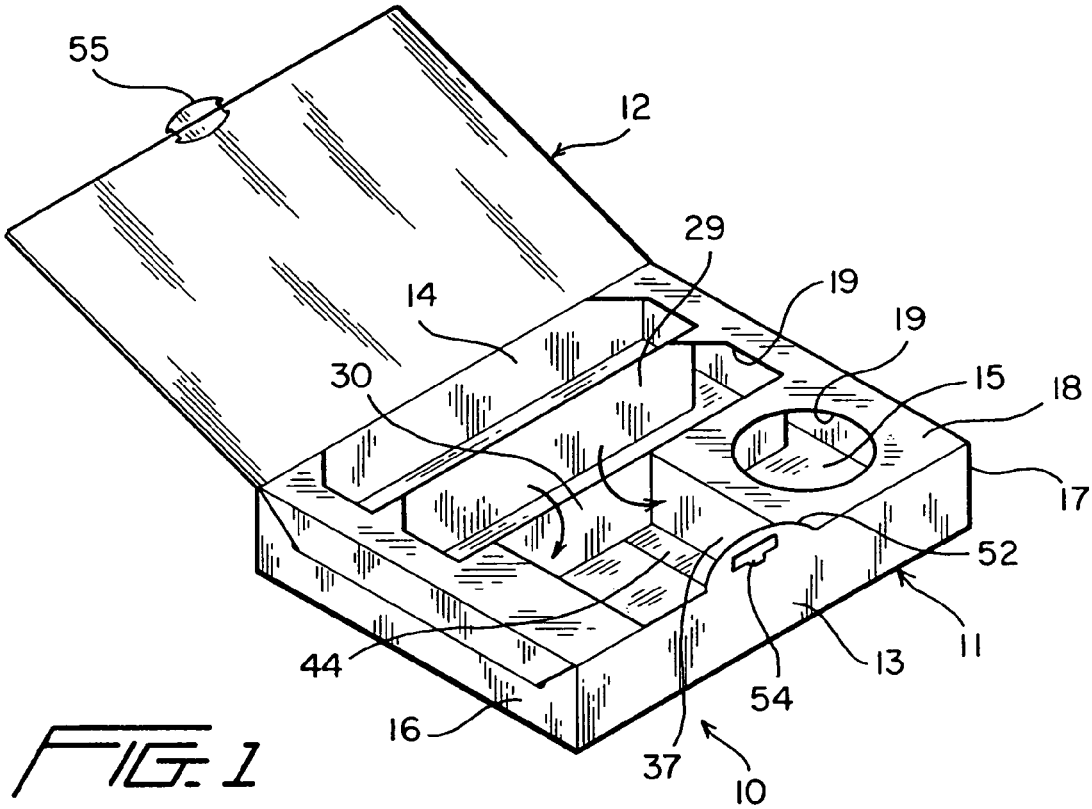
FIG. 1 is a top perspective view of an exemplary package made in accordance with the invention, shown in an expanded and operative condition and with the lid open.

An exemplary food package made in accordance with the invention is indicated generally by reference numeral 10 in the drawings. The package 10 comprises a shallow rectangular base or tray portion 11 and a detachable double thickness lid 12 integrally formed with the tray portion 11. The tray portion 11 has a front wall 13, back wall 14, bottom wall 15, opposite end walls 16 and 17, and top wall 18. A plurality of openings 19 are formed in the top wall 18 for receiving food items, beverage cups, game pieces, and the like (not shown).

Figure 2:
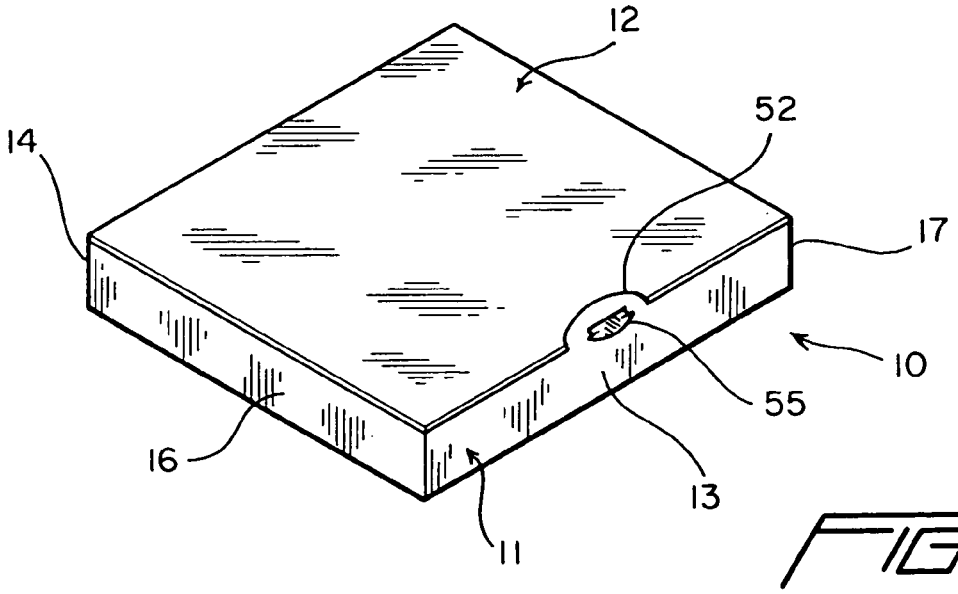
FIG. 2 is a top perspective view of the exemplary package, on a reduced scale, with the lid closed.

The package 10 is formed from a single blank B of paperboard material (FIG. 3) that is cut, folded and glued to form a flattened tubular structure (FIGS. 6 and 7) that may be stored and shipped in that flattened condition, and expanded at the point of use into an expanded and operative condition, as shown in FIGS. 1 and 2.

Figure 3:
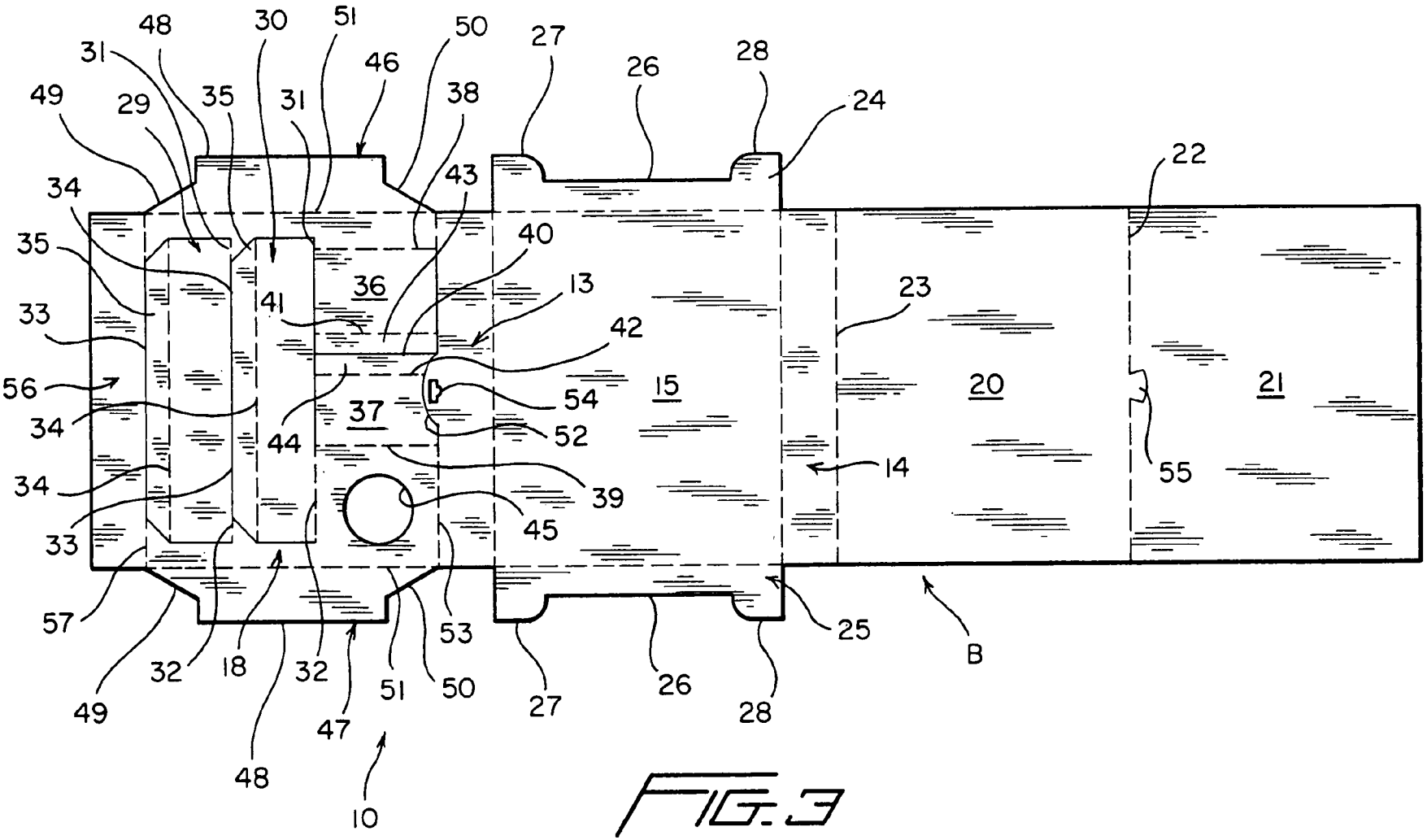
FIG. 3 is a top plan view of the single piece blank from which the exemplary package is made.

Referring to FIG. 3, the blank B includes a first lid panel 20 and a second lid panel 21 joined along a hinge line 22. The two lid panels 20, 21 are folded on top of one another and glued to form the double thickness lid 12 hinged along a perforated tear line 23 to the top of the back wall 14 of the package (FIG. 1).

The back wall 14 is foldably joined along one edge to a first side edge of bottom panel 15, which has a pair of end closure flaps 24 and 25 foldably joined to its opposite end edges. The end closure flaps 24 and 25 have a recessed central portion 26, with a pair of outwardly projecting tabs 27 and 28 on the opposite sides of the free edge.

The front wall 13 is foldably joined along one edge to a second side edge of the bottom panel, and the compartment-forming top wall 18 is foldably joined to the opposite edge of the front wall 13. The openings 19 in the top wall 18 are formed by a series of die cuts, defining two elongate, longitudinal, first partition panels 29 and 30 extending parallel to the side edges of the top wall 18, with portions 31 and 32 of one edge pivotably connected to the top wall 18, and having an opposite free edge 33. A fold line 34 extends parallel to the free edge, defining a foot flange 35 on each of said longitudinal first partition panels 29, 30.

Two transverse second partition panels 36 and 37 are formed on the top wall 18 between first partition panel 30 and the front wall 13. These second partition panels 36, 37 are oriented perpendicularly to the first partition panels 29, 30, and are joined to the top wall 18 at their respective outer end edges along hinge lines 38 and 39 extending perpendicular to the opposite side edges of the top wall 18, and are separated from one another by a cut 40. Fold lines 41 and 42 are formed adjacent the free edges of the partition panels 36 and 37, defining foot flanges 43 and 44, respectively, on the panels 36 and 37.

A circular opening 45 is formed in the top wall 18 between hinge line 39 and the adjacent end edge of the top wall 18 for holding a cup or other object (not shown).

A second set of end closure flaps 46 and 47 are formed on opposite end edges of the top wall 18, and each of these flaps has a protruding central tongue 48, with diagonal shoulders 49 and 50 extending to opposite ends of a fold line 51 joining that flap to the top wall 18.

An arcuate cut 52 extends from a line colinear with the hinge line 53 joining the top wall 18 to the front wall 13, and extends into the side edge of one of the partition panels 37, forming an arcuate tab when the panels are folded into the expanded and operative condition. See FIG. 1. A T-shaped slot or opening 54 is formed in this tab for receiving a tab 55 formed on the outer free edge of the lid when the two lid panels 20 and 21 are folded about fold line 22 into overlying relationship with one another and glued together to form a double thickness lid 12.

A glue flap 56 is foldably connected along a hinge line 57 to the side edge of top panel 18 opposite the side that is joined to front wall 13.

Figure 4:
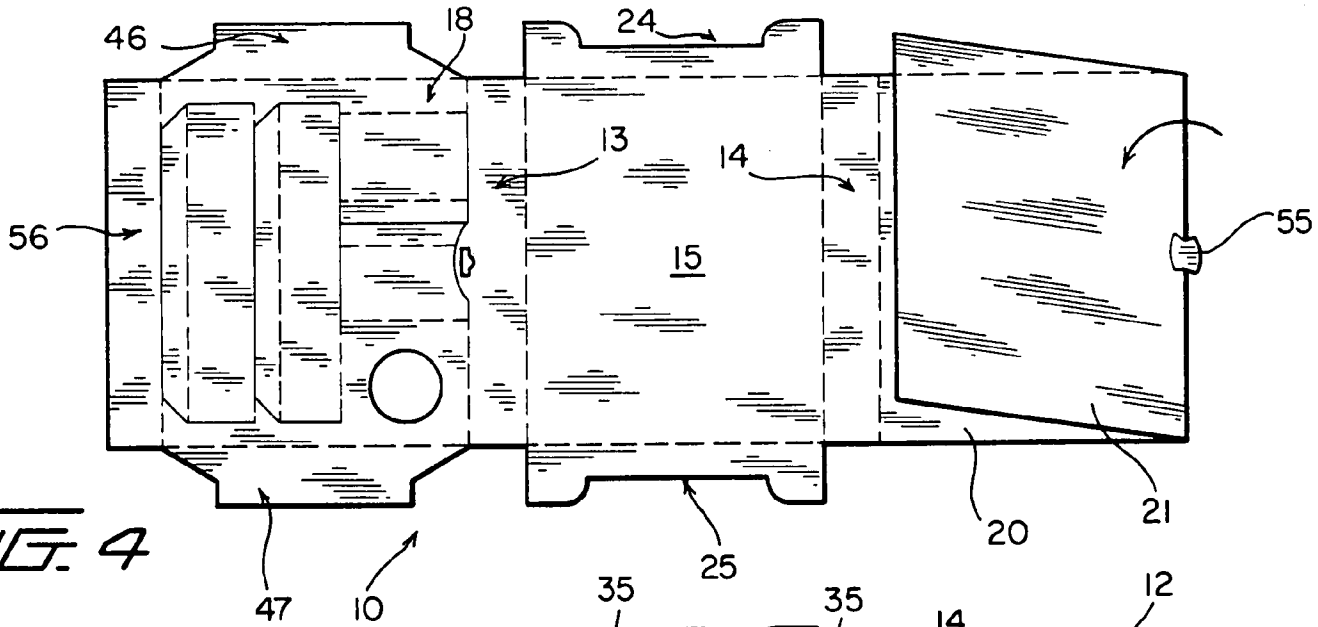
FIG. 4 is a top plan view of the blank, showing one of the lid panels being folded over the other lid panel so that it can be glued to it to form a double thickness lid.
Figure 5:
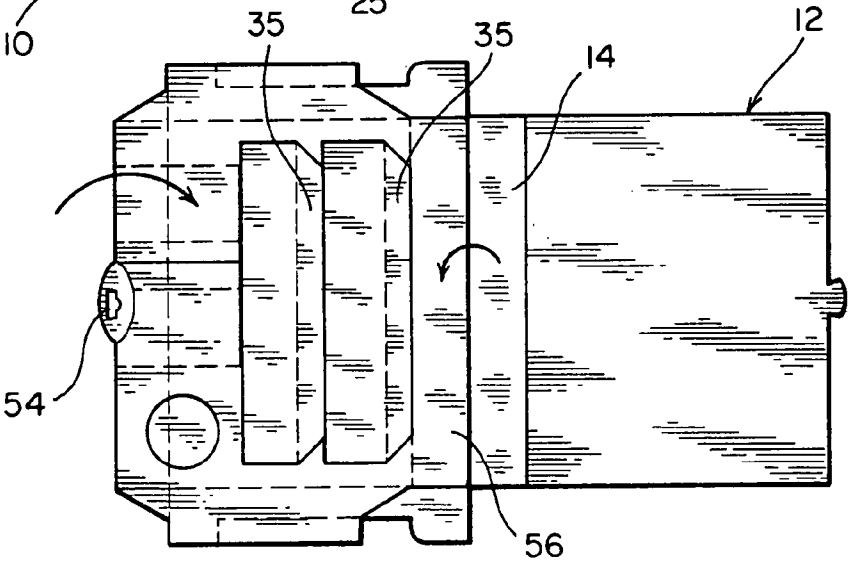
FIG. 5 is a top plan view of the exemplary package, showing the die-cut top panel folded inwardly over the bottom panel, so that the foot flanges of two partition panels can be glued to the bottom panel.

The manufacturer folds the lid panels 10 and 11 on top of one another and glues them together, as depicted in FIGS. 4 and 5, and folds the die-cut top wall or panel 18 over the bottom wall 15 and glues the foot flanges 35 of partition panels 29 and 30 to the face of the bottom wall 15. The back wall 14, to which the lid 12 is attached, is pivoted onto glue flap 56 and glued to form a flattened tubular structure. The lid may then be pivoted into flat, overlying relationship with the flattened tubular structure, as shown in FIGS. 6 and 7.

Figure 8:
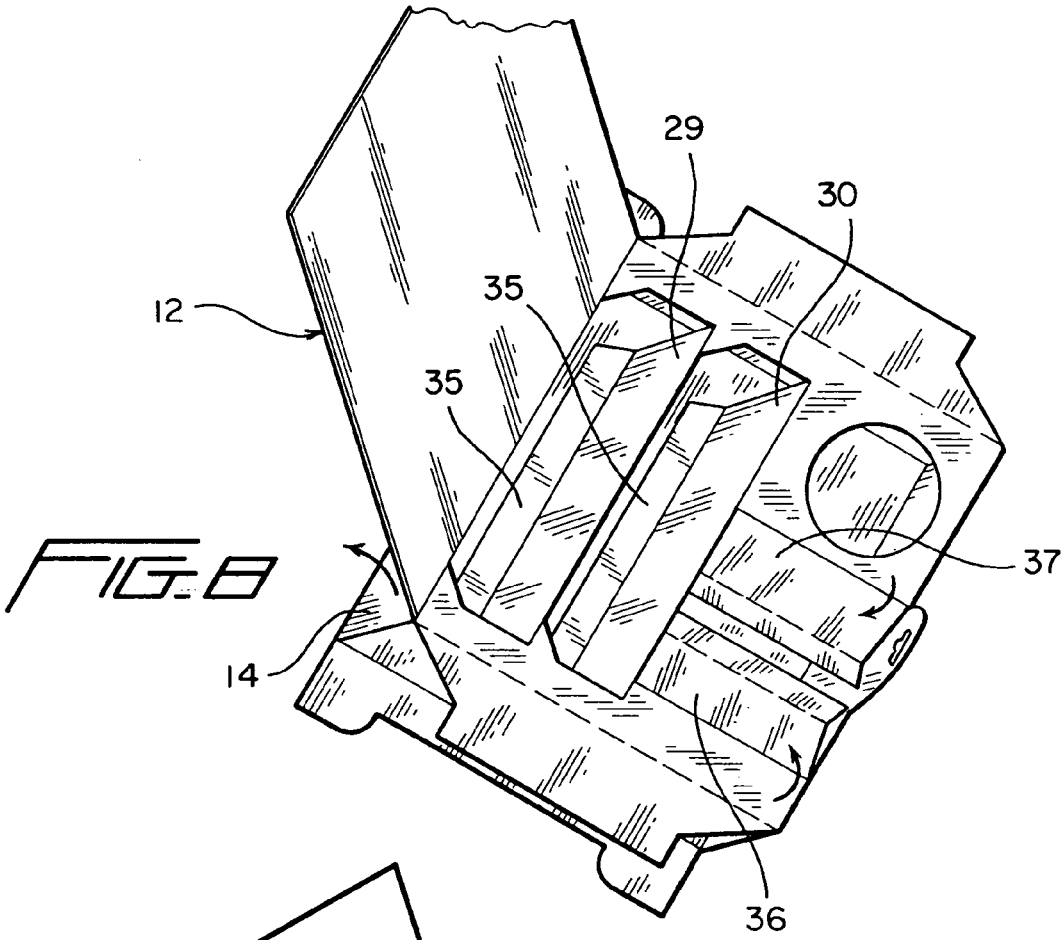
FIG. 8 is a top perspective view of the exemplary package in a partially expanded condition, showing how the flattened tubular structure is expanded by pivoting the pre-glued panels about fold lines to bring the top panel into parallel spaced relationship to the bottom panel, and how two transverse compartment-forming partition panels are folded downwardly into the space between the top and bottom panels to hold the package in the expanded and operative condition.
Figure 9:
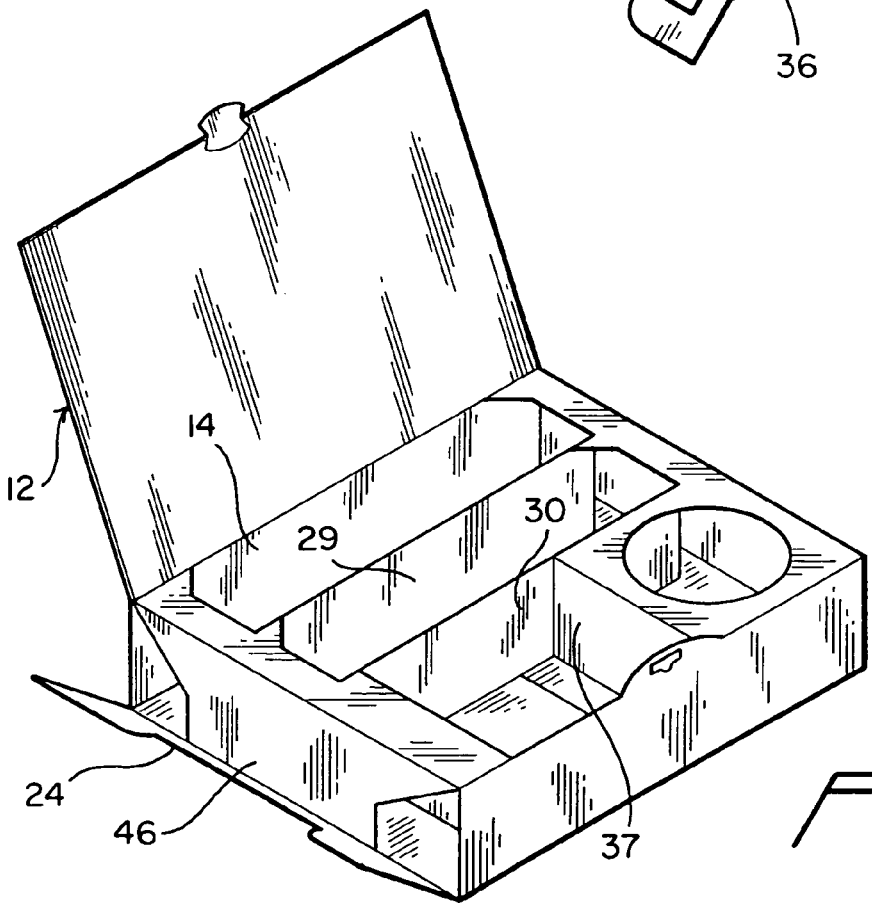
FIG. 9 is a top perspective view of the exemplary package in the fully expanded and operative condition, with the end closure flaps at one end of the package folded inwardly and interlocked with one another, and the end closure flaps at the other end in a partially folded condition.

When it is desired to erect the package 10, the front and back walls 13 and 14, respectively, are pivoted into an upright position, placing the top wall 18 in parallel, spaced relationship to the bottom wall 15. The transverse partition panels 36 and 37 are then pressed downwardly into the space between the top and bottom walls 18, 15, bringing their foot flanges 43 and 44 into frictional engagement with the bottom wall 15 and their opposite side edges into frictional engagement between the partition panel 30 and front wall 13, which are now in upright, parallel relationship to one another. Due to the engagement of these transverse partition panels between the front wall 13 and adjacent glued partition panel 30, they serve to hold the package 10 in its expanded and operative condition. See FIG. 8.

The end closure flaps 24 and 25 are then folded inwardly over the open ends of the package 10, after which the closure flaps 46 and 47 are folded and pressed inwardly to extend the tongues 48 through the central recesses 26 in flaps 24 and 25, with the tabs 27 and 28 on opposite edges of the flaps 24 and 25 engaged behind the diagonal shoulders 49 and 50 of flaps 46 and 47. This interlocking of the end closure flaps on the top and bottom walls is easily accomplished by simply folding them into generally overlying relationship and then pressing inwardly to cause the tabs to "snap" behind the shoulders. The interlocked end closure flaps serve to securely lock the package 10 in its expanded and operative condition.

The double thickness lid 12 can be pivoted into closing relationship over the top wall 18 and secured in closed position by inserting the tab 55 into slot 54.

In configuration, the package 10 has an appearance somewhat similar to a laptop computer and can have graphics applied to enhance that impression, producing an entertaining device that can attract and hold the attention of children. Alternatively, suitable graphics, such as a game or puzzle, for example, can be placed on the lid 12, and because of the stiffness and durability imparted to the lid 12 by its double thickness, the lid 12 can be separated from the package 10 along the perforated line 23 and used separately as a game piece or collectible item or other separately usable device, as desired.

Although particular embodiments of the invention are illustrated and described in detail herein, it is to be understood that various changes and modifications may be made to the invention without departing from the spirit and intent of the invention as defined by the scope of the appended claims.

What is claimed is:

1. A pre-assembled compartmented food package that may be stored and shipped in a flattened condition and erected into an expanded and operative condition at the point of use, comprising:

a shallow rectangular tray portion having front and back walls, opposite end walls, a top wall and a bottom wall, each of said end walls comprising releasably interengaged end closure flaps, and said front and back walls being pivotably connected at top and bottom edges thereof to the top wall and bottom wall, respectively, whereby said front and back walls may be pivoted to collapse said top and bottom walls on top of one another to flatten said tray portion for storage and shipment in the flattened condition, or to move said top and bottom walls apart to expand said tray portion for use in the expanded and operative condition, said top wall having at least one opening therein for holding an object, said at least one opening being formed by a cut in the top wall that defines a transverse partition panel which is foldable into generally perpendicular relationship to the top and bottom walls and to the front and back walls;

wherein there are also plural openings in the top wall, formed by cuts that define a longitudinal partition panel which is foldable into generally perpendicular relationship to the top and bottom walls and to said transverse partition panel, such that the edges of said transverse partition panel, when it is folded, frictionally engage against (a) the bottom wall and (b) between (i) one of the front and back walls and (ii) said longitudinal partition panel to hold the tray portion in the expanded and operative condition.

2. The food package as recited in claim 1, wherein:

said longitudinal partition panel is connected along a hinge line at one edge thereof to the top wall, and a narrow foot flange on an opposite edge is adhesively secured to the bottom wall.

3. The food package as recited in claim 1, wherein:

there are two transverse partition panel arranged in opposed relationship to one another, said transverse partition panels being arranged to be spaced from one another when they are folded.

4. The food package as recited in claim 1, wherein:

there are two longitudinal partition panels arranged in parallel, spaced relationship to one another when they are folded.

5. The food package as recited in claim 1, wherein:

a glue flap is hinged along an edge of the top wall, said glue flap being adhesively secured to said back wall so that said top wall lies parallel to said bottom wall, and said front and back walls lie parallel to one another.

6. The food package as recited in claim 1, wherein:

said end closure flaps of each end wall include a first end closure flap which is foldably attached along one edge to an end edge of the bottom wall, and a second end closure flap which is foldably attached along one edge to an end edge of the top wall.

7. The food package as recited in claim 6, wherein:

said first end closure flap has a free edge opposite the edge attached to the bottom wall, and an elongated central notch is formed in the free edge of said first end closure flap, defining a pair of outwardly projecting tabs at opposite ends of said free edge;

said second end closure flap has a free edge opposite the edge attached to the top wall, an outwardly projecting central tongue on said free edge, and a sloping shoulder extending from a base of the tongue to opposite corners of the top wall; and each of said end walls are formed by folding said first end closure flap and said second end closure flap inwardly against one another to extend the central tongue on the second end closure flap through the central notch and behind the first end closure flap, and engage the tabs at opposite sides of said first end closure flap behind the sloping shoulders of the second end closure flap.

8. The food package as recited in claim 1, wherein:

a lid is pivotably connected along one edge to a top edge of said back wall for opening and closing movement relative to the tray portion.

9. The food package as recited in claim 8, wherein:

said lid is of double wall construction, imparting stiffness and durability to it.

10. The food package as recited in claim 8, wherein:

said lid comprises a game piece which is usable apart from its use as a lid to cover the tray portion.

11. The food package as recited in claim 8, wherein:

said lid is detachable from said tray portion along a perforated hinge line.

12. A one piece paperboard blank for forming a food package that can be stored and shipped in a flattened condition and opened to an expanded and operative condition at the point of use, comprising:

a rectangular bottom-wall-forming panel having opposite, parallel, first and second side edges and opposite, parallel, first and second end edges;

a narrow rectangular back-wall-forming panel having opposite, parallel, first and second edges, and connected along a fold line at the first edge thereof to the first side edge of the bottom-wall-forming panel;

a first rectangular lid-forming panel having opposite, parallel, first and second side edges, and connected along a fold line at the first side edge thereof to the second edge of the back-wall-forming panel;

a second rectangular lid-forming panel having opposite, parallel, first and second side edges, and connected along a fold line at the first side edge thereof to the second side edge of the first lid-forming panel, said first and second lid-forming panels being adapted to be folded into overlying relationship with one another and adhesively secured together to form a double thickness lid;

a narrow rectangular front-wall-forming panel having opposite, parallel, first and second edges, and connected along a fold line at the first edge thereof to the second side edge of the bottom-wall-forming panel;

a rectangular top-wall-forming panel having opposite, parallel, first and second side edges and opposite, parallel, first and second end edges, and connected along a fold line at the first side edge thereof to the second edge of the front-wall-forming panel;

a glue flap foldably connected along one edge to the second side edge of the top-wall-forming panel;

a first end closure flap foldably connected to each of the first and second end edges of the bottom-wall-forming panel; and a second end closure flap foldably connected to each of the first and second end edges of the top-wall-forming panel, said first and second end closure flaps being adapted to be folded into interlocking relationship with one another when the blank is erected to form a package;

wherein a plurality of cuts are made in said top-wall-forming panel, which, when the package is erected from the blank, define a plurality of openings in said top-wall-forming panel for receiving an item, and also define a plurality of partition panels, and when the blank is folded and erected to form the package, said top-wall-forming panel and said bottom-wall-forming panel are disposed in spaced parallel relationship to one another, with at least one of said partition panels extending perpendicularly between said top-wall-forming panel and said bottom-wall-forming panel, with said glue flap adhesively secured to said front-wall-forming panel; and wherein said plurality of partition panels includes a first partition panel that extends parallel to the opposite side edges of the top-wall-forming panel and a second partition panel that extends transverse to the first partition panel, and said second partition panel having dimensions such that when the blank is erected to form the package, opposite side edges of the second partition panel frictionally engage between the first partition panel and the front-wall-forming panel or the back-wall-forming to hold the package in the expanded and operative condition.

* * * * *

UNITED STATES PATENT AND TRADEMARK OFFICE

CERTIFICATE OF CORRECTION

PATENT NO. : 7,293,695 B2
APPLICATION NO. : 10/474618
DATED : November 13, 2007
INVENTOR(S) : Stier et al.

It is certified that error appears in the above-identified patent and that said Letters Patent is hereby corrected as shown below:

On the Title page, item number 75, Inventor:

Add: Jeffrey W. Yandian, Marietta, OK

In the claims:

Claim 3, col. 5, line 40: Change the word "panel" to read --panels--

Signed and Sealed this

Eleventh Day of March, 2008

JON W. DUDAS
*Director of the United States Patent and Trademark Office*